US010395660B2

(12) United States Patent
Uhle et al.

(10) Patent No.: US 10,395,660 B2
(45) Date of Patent: Aug. 27, 2019

(54) APPARATUS AND METHOD FOR MULTICHANNEL DIRECT-AMBIENT DECOMPOSTION FOR AUDIO SIGNAL PROCESSING

(71) Applicant: Fraunhofer-Gesellschaft zur Foerderung der angewandten Forschung e.V., Munich (DE)

(72) Inventors: Christian Uhle, Nuremburg (DE); Emanuel Habets, Spardorf (DE); Patrick Gampp, Erlangen (DE); Michael Kratz, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/846,660

(22) Filed: Sep. 4, 2015

(65) Prior Publication Data

US 2015/0380002 A1 Dec. 31, 2015

Related U.S. Application Data

(63) Continuation of application No. PCT/EP2013/072170, filed on Oct. 23, 2013.
(Continued)

(51) Int. Cl.
*G10L 19/008* (2013.01)
*G10L 21/028* (2013.01)
(Continued)

(52) U.S. Cl.
CPC ..... *G10L 19/008* (2013.01); *G10L 21/028* (2013.01); *G10L 25/18* (2013.01);
(Continued)

(58) Field of Classification Search
CPC ... H04S 7/307; H04S 3/02; H04S 3/00; H04S 2400/01; H04S 2400/03; H04S 2400/05;
(Continued)

(56) References Cited

U.S. PATENT DOCUMENTS 8,036,767 B2 10/2011 Soulodre et al.
2007/0154031 A1 7/2007 Avendano et al.
(Continued)

FOREIGN PATENT DOCUMENTS

CN 101636783 A 1/2010
CN 102792374 A 11/2012
(Continued)

OTHER PUBLICATIONS

Allen, J.B. et al., "Multimicrophone signal-processing technique to remove room reverberation from speech signals", Journal of Acoustical Society of America, vol. 62, Oct. 1977, pp. 912-915.
(Continued)

*Primary Examiner* — Vivian C Chin
*Assistant Examiner* — Douglas J Suthers
(74) *Attorney, Agent, or Firm* — Perkins Coie, LLP; Michael A. Glenn

(57) ABSTRACT

An apparatus for generating one or more audio output channel signals depending on two or more audio input channel signals is provided. Each of the two or more audio input channel signals comprises direct signal portions and ambient signal portions. The apparatus comprises a filter determination unit for determining a filter by estimating first power spectral density information and by estimating second power spectral density information. Moreover, the apparatus comprises a signal processor for generating the one or more audio output channel signals by applying the filter on the two or more audio input channel signals. The first power spectral density information indicates power spectral density infor-
(Continued)

mation on the two or more audio input channel signals, and the second power spectral density information indicates power spectral density information on the ambient signal portions of the two or more audio input channel signals.

14 Claims, 5 Drawing Sheets

Related U.S. Application Data

(60) Provisional application No. 61/772,708, filed on Mar. 5, 2013.

(51) Int. Cl.

| | |
|---|---|
| ***G10L 25/18*** | (2013.01) |
| ***G10L 25/21*** | (2013.01) |
| ***H04R 3/00*** | (2006.01) |
| ***H04R 3/02*** | (2006.01) |
| ***H04S 3/00*** | (2006.01) |
| ***H04S 3/02*** | (2006.01) |

(52) U.S. Cl.
CPC ..... *G10L 25/21* (2013.01); *H04S 3/008* (2013.01); *H04S 3/02* (2013.01); *H04S 2400/01* (2013.01)

(58) Field of Classification Search
CPC ..... H04S 3/008; G10L 19/008; G10L 25/18; G10L 21/028; G10L 25/21
USPC ..... 381/27, 107
See application file for complete search history.

(56) References Cited

U.S. PATENT DOCUMENTS

| | | | |
|---|---|---|---|
| 2009/0080666 | A1 | 3/2009 | Uhle et al. |
| 2010/0030563 | A1 | 2/2010 | Uhle et al. |
| 2010/0094633 | A1 | 4/2010 | Kawamura et al. |
| 2013/0006619 | A1 | 1/2013 | Muesch et al. |
| 2013/0216047 | A1 | 8/2013 | Kuech et al. |
| 2015/0380002 | A1 | 12/2015 | Uhle et al. |

FOREIGN PATENT DOCUMENTS

| | | | |
|---|---|---|---|
| CN | 102859590 | A | 1/2013 |
| JP | 2009522942 | A | 6/2009 |
| JP | 2016513814 | A | 5/2016 |
| KR | 20120128143 | A | 11/2012 |
| WO | 2011104146 | A1 | 9/2011 |

OTHER PUBLICATIONS

Avendano, Carlos et al., "A Frequency-Domain Approach to Multichannel Upmix", Journal of the Audio Engineering society, Audio, Engineering Society, vol. 52, No. 7/8, Jul./Aug. 2004, pp. 740-749.

Faller, Christof, "Multiple-Loudspeaker Playback of Stereo Signals", Journal of Audio Engineering Society; vol. 54, No. 11, Nov. 2006, 1051-1064.

Habets, et al., "New Insights Into the MVDR Beamformer in Room Acoustics", IEEE Transaction on Audio, Speech and Language Processing, vol. 18, No. 1, Jan. 2010, pp. 158-170.

McCowan, I. et al., "Microphone Array Post-Filter for Diffuse Noise Field", IEEE Int'l Conference on Acoustics, Speech and Signal Processing; Orlando, FL, May 13-17, 2002, pp. I-905-I-908.

Merimaa, et al., "Correlation-based ambience extraction from stereo recordings", Proceedings of the AES 123rd Convention; New York, NY, Oct. 5-8, 2007, 15 pages.

Pulkki, Ville , "Directional audio coding in spatial sound reproduction and stereo upmixing", AES 28th International Conference, Piteå, Sweden, Jun. 30 to Jul. 2, 2006, pp. 1-8.

Usher, John et al., "Enhancement of spatial sound quality: A new reverberation-extraction audio upmixer", IEEE Transactions on Audio, Speech, and Language Processing, vol. 15, No. 7, Sep. 2007, pp. 2141-2150.

Walther, A. et al., "Direct-ambient decomposition and upmix of surround sound signals", IEEE Workshop on Applications of Signal Processing to Audio and Acoustics, New Paltz, NY, Oct. 16-19, 2011, pp. 277-280.

APPARATUS AND METHOD FOR MULTICHANNEL DIRECT-AMBIENT DECOMPOSTION FOR AUDIO SIGNAL PROCESSING

CROSS-REFERENCE TO RELATED APPLICATIONS

This application is a continuation of copending International Application No. PCT/EP2013/072170, filed Oct. 23, 2013, which claims priority from U.S. Provisional Application No. 61/772,708, Mar. 5, 2013, which are each incorporated herein in its entirety by this reference thereto.

BACKGROUND OF THE INVENTION

The present invention relates to an apparatus and method for multichannel direct-ambient decomposition for audio signal processing.

Audio signal processing becomes more and more important. In this field, separation of sound signals into direct and ambient sound signals plays an important role.

In general, acoustic sounds consist of a mixture of direct sounds and ambient (or diffuse) sounds. Direct sounds are emitted by sound sources, e.g. a musical instrument, a vocalist or a loudspeaker, and arrive on the shortest possible path at the receiver, e.g. the listener's ear entrance or microphone.

When listening to a direct sound, it is perceived as coming from the direction of the sound source. The relevant auditory cues for the localization and for other spatial sound properties are interaural level difference, interaural time difference and interaural coherence. Direct sound waves evoking identical interaural level difference and interaural time difference are perceived as coming from the same direction. In the absence of diffuse sound, the signals reaching the left and the right ear or any other multitude of sensors are coherent.

Ambient sounds, in contrast, are emitted by many spaced sound sources or sound reflecting boundaries contributing to the same ambient sound. When a sound wave reaches a wall in a room, a portion of it is reflected, and the superposition of all reflections in a room, the reverberation, is a prominent example for ambient sound. Other examples are audience sounds (e.g. applause), environmental sounds (e.g. rain), and other background sounds (e.g. babble noise). Ambient sounds are perceived as being diffuse, not locatable, and evoke an impression of envelopment (of being "immersed in sound") by the listener. When capturing an ambient sound field using a multitude of spaced sensors, the recorded signals are at least partially incoherent.

Various applications of sound post-production and reproduction benefit from a decomposition of audio signals into direct signal components and ambient signal components. The main challenge for such signal processing is to achieve high separation while maintaining high sound quality for an arbitrary number of input channel signals and for all possible input signal characteristics. Direct-ambient decomposition (DAD), i.e. the decomposition of audio signals into direct signal components and ambient signal components, enables the separate reproduction or modification of the signal components, which is for example desired for the upmixing of audio signals.

The term upmixing refers to the process of creating a signal with P channels given an input signal with N channels where P>N. Its main application is the reproduction of audio signals using surround sound setups having more channels than available in the input signal. Reproducing the content by using advanced signal processing algorithms enables the listener to use all available channels of the multichannel sound reproduction setup. Such processing may decompose the input signal into meaningful signal components (e.g. based on their perceived position in the stereo image, direct sounds versus ambient sounds, single instruments) or into signals where these signal components are attenuated or boosted.

Two concepts of upmixing are widely known.

1. Guided upmix: upmixing with additional information guiding the upmix process. The additional information may be either "encoded" in a specific way in the input signal or may be stored additionally.
2. Unguided upmix: the output signal is obtained from the audio input signal exclusively without any additional information.

Advanced upmixing methods can be further categorized with respect to the positioning of direct and ambient signals. It is distinguished between the "direct/ambient-approach" and the "In-the-band"-approach. The core component of direct/ambience-based techniques is the extraction of an ambient signal which is fed e.g. into the rear channels or the height channels of a multi-channel surround sound setup. The reproduction of ambience using the rear or height channels evokes an impression of envelopment (being "immersed in sound") by the listener. Additionally, the direct sound sources can be distributed among the front channels according to their perceived position in the stereo panorama. In contrast, the "In-the-band"-approach aims at positioning all sounds (direct sound as well as ambient sounds) around the listener using all available loudspeakers.

Decomposing an audio signal into direct and ambient signals also enables the separate modification of the ambient sounds or direct sounds, e.g. by scaling or filtering it. One use case is the processing of a recording of a musical performance which has been captured with a too high amount of ambient sound. Another use case is audio production (e.g. for movie sound or music), where audio signals captured at different locations and therefore having different ambient sound characteristics are combined.

In any case, the requirements for such signal processing is to achieve high separation while maintaining high sound quality for an arbitrary number of input channel signals and for all possible input signal characteristics.

Various approaches in the conventional technology for DAD or for attenuating or boosting either the direct signal components or the ambient signal components have been provided, and are briefly reviewed in the following.

Known concepts relates to processing of speech signals with the aim to remove undesired background noise from microphone recordings.

A method for attenuating the reverberation from speech recordings having two input channels is described in [1]. The reverberation signal components are reduced by attenuating the uncorrelated (or diffuse) signal components in the input signal. The processing is implemented in the time-frequency domain such that subband signals are processed by means of a spectral weighting method. The real-valued weighting factors are computed using the power spectral densities (PSD)

$$\phi_{xx}(m,k)=E\{X(m,k)X^*(m,k)\} \tag{1}$$

$$\phi_{yy}(m,k)=E\{Y(m,k)Y^*(m,k)\} \tag{2}$$

$$\phi_{xy}(m,k)=E\{X(m,k)Y^*(m,k)\} \tag{3}$$

where X(m,k) and Y(m,k) denote time-frequency domain representations of the time-domain input signals $x_t[n]$ and $y_t[n]$, E{•} is the expectation operation and X* is the complex conjugate of X.

The original authors point out that different spectral weighting functions are feasible when proportional to $\phi_{xy}$ (m,k), e.g. when using weights equal to the normalized cross-correlation function (or coherence function)

$$\rho(m, k) = \frac{|\Phi_{xy}(m, k)|}{\sqrt{\Phi_{xx}(m, k)\Phi_{yy}(m, k)}}. \tag{4}$$

Following a similar rationale, the method description in [2]extracts an ambient signal using spectral weighting with weights derived from the normalized cross-correlation function computed in frequency bands, sec Formula (4) (or with the words of the original authors, the "interchannel short time coherence function"). The difference compared to [1] is that instead of attenuating the diffuse signal components, the direct signal components are attenuated using the spectral weights which are a monotonic steady function of (1−ρ(m, k)).

The decomposition for the application of upmixing of input signals having two channels using multichannel Wiener filtering has been described in [3]. The processing is done in the time-frequency domain. The input signal is modelled as mixture of the ambient signal and one active direct source (per frequency band), where the direct signal in one channel is restricted to be a scaled copy of the direct signal component in the second channel, i.e. amplitude panning. The panning coefficient and the powers of direct signal and ambient signal are estimated using the normalized cross-correlation and the input signal powers in both channels. The direct output signal and the ambient output signals are derived from linear combinations of the input signals, with real-valued weighting coefficients. Additional postscaling is applied such that the power of the output signals equals the estimated quantities.

The method described in [4] extracts an ambience signal using spectral weighting, based on an estimate of the ambience power. The ambience power is estimate based on the assumptions that the direct signal components in both channels are fully correlated, that the ambient channel signals are uncorrelated with each other and with the direct signals, and that the ambience powers in both channels are equal.

A method for upmixing of stereo signals based on Directional Audio Coding (DirAC) is described in [5]. DirAC aims analyzing and reproducing of direction of arrival, diffuseness and the spectrum of a sound field. For upmixing of stereo input signals, anechoic B-format recordings of the input signals are simulated.

A method for extracting the uncorrelated reverberation from stereo audio signal using an adaptive filter algorithm which aims at predicting the direct signal component in one channel signal using the other channel signal by means of a Least Mean Square (LMS) algorithm is described in [6]. Subsequently the ambient signals are derived by subtracting the estimated direct signals from the input signals. The rationale of this approach is that the prediction only works for correlated signals and the prediction error resembles the uncorrelated signal. Various adaptive filter algorithms based on the LMS principle exist and are feasible, e.g. the LMS or the Normalized LMS (NLMS) algorithm.

For the decomposition of input signals with more than two channels, a method is described in [7] where the multichannel signals are firstly downmixed to obtain a 2-channel stereo signal and subsequently a method for processing stereo input signals presented in [3] is applied.

For the processing of mono signals, the method described in [8] extracts an ambience signal using spectral weighting where the spectral weights are computed using feature extraction and supervised learning.

Another method for extracting an ambience signal from mono recordings for the application of upmixing obtains the time-frequency domain representation from the difference of the time-frequency domain representation of the input signal and a compressed version of it, advantageously computed using non-negative matrix factorization [9].

A method for extracting and changing the reverberant signal components in an audio signal based on the estimation of the magnitude transfer function of the reverberant system which has generated the reverberant signal is described in [10]. An estimate of the magnitudes of the frequency domain representation of the signal components is derived by means of recursive filtering and can be modified.

SUMMARY

According to an embodiment, an apparatus for generating one or more audio output channel signals depending on two or more audio input channel signals, wherein each of the two or more audio input channel signals includes direct signal portions and ambient signal portions, may have: a filter determination unit for determining a filter by estimating first power spectral density information and by estimating second power spectral density information, and a signal processor for generating the one or more audio output channel signals by applying the filter on the two or more audio input channel signals, wherein the first power spectral density information indicates power spectral density information on the two or more audio input channel signals, and the second power spectral density information indicates power spectral density information on the ambient signal portions of the two or more audio input channel signals, or wherein the first power spectral density information indicates the power spectral density information on the two or more audio input channel signals, and the second power spectral density information indicates power spectral density information on the direct signal portions of the two or more audio input channel signals, or wherein the first power spectral density information indicates the power spectral density information on the direct signal portions of the two or more audio input channel signals, and the second power spectral density information indicates the power spectral density information on the ambient signal portions of the two or more audio input channel signals.

According to another embodiment, a method for generating one or more audio output channel signals depending on two or more audio input channel signals, wherein each of the two or more audio input channel signals includes direct signal portions and ambient signal portions, may have the steps of: determining a filter by estimating first power spectral density information and by estimating second power spectral density information, and generating the one or more audio output channel signals by applying the filter on the two or more audio input channel signals, wherein the first power spectral density information indicates power spectral density information on the two or more audio input channel signals, and the second power spectral density information indicates power spectral density information on the ambient signal portions of the two or more audio input channel signals, or wherein the first power spectral density information indicates the power spectral density information on the two or more audio input channel signals, and the second power spectral density information indicates power spectral density information on the direct signal portions of the two or more audio input channel signals, or wherein the first power spectral density information indicates the power spectral density information on the direct signal portions of the two or more audio input channel signals, and the second power spectral density information indicates the power spectral density information on the ambient signal portions of the two or more audio input channel signals.

Another embodiment may have a computer program for implementing the inventive method when being executed on a computer or processor.

An apparatus for generating one or more audio output channel signals depending on two or more audio input channel signals is provided. Each of the two or more audio input channel signals comprises direct signal portions and ambient signal portions. The apparatus comprises a filter determination unit for determining a filter by estimating first power spectral density information and by estimating second power spectral density information. Moreover, the apparatus comprises a signal processor for generating the one or more audio output channel signals by applying the filter on the two or more audio input channel signals. The first power spectral density information indicates power spectral density information on the two or more audio input channel signals, and the second power spectral density information indicates power spectral density information on the ambient signal portions of the two or more audio input channel signals. Or, the first power spectral density information indicates the power spectral density information on the two or more audio input channel signals, and the second power spectral density information indicates power spectral density information on the direct signal portions of the two or more audio input channel signals. Or, the first power spectral density information indicates the power spectral density information on the direct signal portions of the two or more audio input channel signals, and the second power spectral density information indicates the power spectral density information on the ambient signal portions of the two or more audio input channel signals.

Embodiments provide concepts for decomposing audio input signals into direct signal components and ambient signal components, which can be applied for sound post-production and reproduction. The main challenge for such signal processing is to achieve high separation while maintaining high sound quality for an arbitrary number of input channel signals and for all possible input signal characteristics. The provided concepts are based on multichannel signal processing in the time-frequency domain which leads to a constrained optimal solution in the mean squared error sense, and, e.g. subject to constraints on the distortion of the estimated desired signals or on the reduction of the residual interference.

Embodiments for decomposing audio input signals into direct signals components and ambient signal components are provided. Furthermore, a derivation of filters for computing the ambient signal components will be provided, and moreover, embodiments for the applications of the filters are described.

Some embodiments relate to the unguided upmix following the direct/ambient-approach with input signals having more than one channel.

For the envisaged applications of the described decomposition, one is interested in computing output signals having the same number of channels as the input signal. For this application, embodiments provide very good results in terms of separation and sound quality, because it can cope with input signals where the direct signals are time delayed between the input channels. In contrast to other concepts, e.g. the concepts provided in [3], embodiments do not assume that the direct sounds in the input signals are panned by scaling only (amplitude panning), but also by introducing time differences between the direct signals in each channel.

Furthermore, embodiments are able to operate on input signal having an arbitrary number of channels, in contrast to all other concepts in the conventional technology (see above) which can only process input signals having one or two channels.

Other advantages of embodiments are the use of the control parameters, the estimation of the ambient PSD matrix and further modifications of the filter as described below.

Some embodiments provide consistent ambient sounds for all input sound objects. When the input signals are decomposed into direct and ambient sounds, some embodiments adapt the ambient sound characteristics by means of appropriate audio signal processing, and other embodiments replace the ambient signal components by means of artificial reverberation and other artificial ambient sounds.

According to an embodiment, the apparatus may further comprise an analysis filterbank being configured to transform the two or more audio input channel signals from a time domain to a time-frequency domain. The filter determination unit may be configured to determine the filter by estimating the first power spectral density information and the second power spectral density information depending on the audio input channel signals, being represented in the time-frequency domain. The signal processor may be configured to generate the one or more audio output channel signals, being represented in a time-frequency domain, by applying the filter on the two or more audio input channel signals, being represented in the time-frequency domain. Moreover, the apparatus may further comprise a synthesis filterbank being configured to transform the one or more audio output channel signals, being represented in a time-frequency domain, from the time-frequency domain to the time domain.

Moreover, a method for generating one or more audio output channel signals depending on two or more audio input channel signals is provided. Each of the two or more audio input channel signals comprises direct signal portions and ambient signal portions. The method comprises:

Determining a filter by estimating first power spectral density information and by estimating second power spectral density information. And:

Generating the one or more audio output channel signals by applying the filter on the two or more audio input channel signals.

The first power spectral density information indicates power spectral density information on the two or more audio input channel signals, and the second power spectral density information indicates power spectral density information on the ambient signal portions of the two or more audio input channel signals. Or, the first power spectral density information indicates the power spectral density information on the two or more audio input channel signals, and the second power spectral density information indicates power spectral density information on the direct signal portions of the two or more audio input channel signals. Or, the first power spectral density information indicates the power spectral density information on the direct signal portions of the two or more audio input channel signals, and the second power spectral density information indicates the power spectral density information on the ambient signal portions of the two or more audio input channel signals.

Moreover, a computer program for implementing the above-described method when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
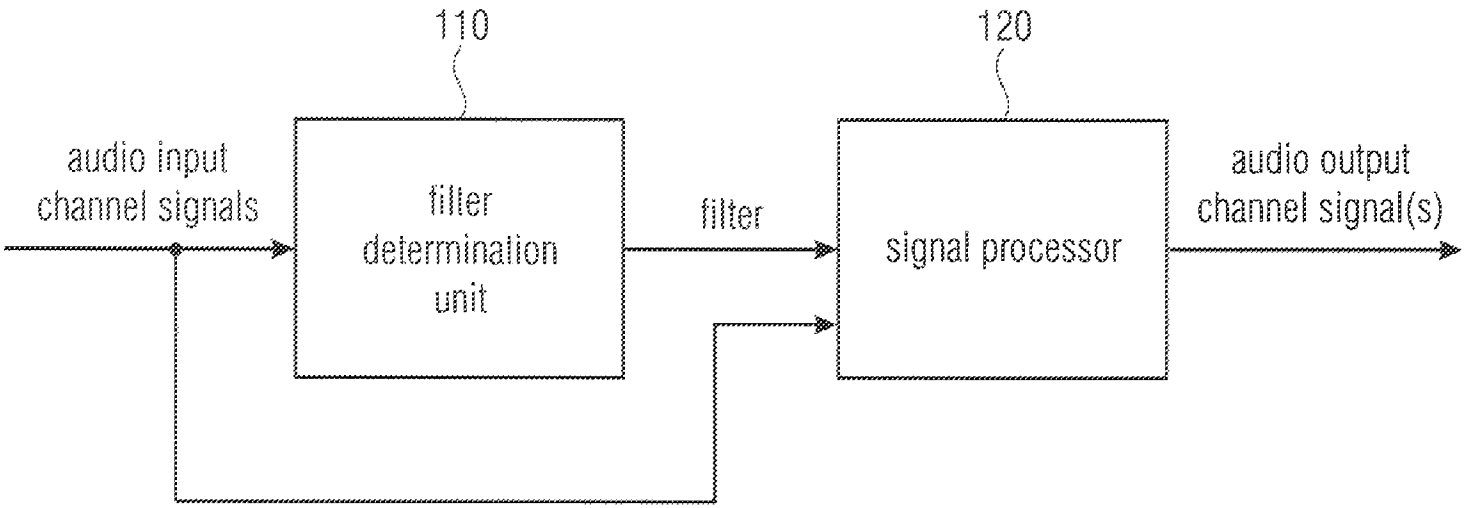
FIG. 1 illustrates an apparatus for generating one or more audio output channel signals depending on two or more audio input channel signals according to an embodiment.

FIG. 1 illustrates an apparatus for generating one or more audio output channel signals depending on two or more audio input channel signals according to an embodiment. Each of the two or more audio input channel signals comprises direct signal portions and ambient signal portions.

The apparatus comprises a filter determination unit 110 for determining a filter by estimating first power spectral density information and by estimating second power spectral density information.

Moreover, the apparatus comprises a signal processor 120 for generating the one or more audio output channel signals by applying the filter on the two or more audio input channel signals.

The first power spectral density information indicates power spectral density information on the two or more audio input channel signals, and the second power spectral density information indicates power spectral density information on the ambient signal portions of the two or more audio input channel signals.

Or, the first power spectral density information indicates the power spectral density information on the two or more audio input channel signals, and the second power spectral density information indicates power spectral density information on the direct signal portions of the two or more audio input channel signals.

Or, the first power spectral density information indicates the power spectral density information on the direct signal portions of the two or more audio input channel signals, and the second power spectral density information indicates the power spectral density information on the ambient signal portions of the two or more audio input channel signals.

Embodiments provide concepts for decomposing audio input signals into direct signal components and ambient signal components are described which can be applied for sound post-production and reproduction. The main challenge for such signal processing is to achieve high separation while maintaining high sound quality for an arbitrary number of input channel signals and for all possible input signal characteristics. The provided embodiments are based on multichannel signal processing in the time-frequency domain and provide an optimal solution in the mean squared error sense subject to constraints on the distortion of the estimated desired signals or on the reduction of the residual interference.

At first, inventive concepts are described, on which embodiments of the present invention are based.

It is assumed that N input channel signals $y_t[n]$ are received:

$$y_t[n]=[y_1[n] \ldots y_N[n]]^T. \tag{5}$$

For example, N≥2. The aim of the provided concepts is to decompose the input channel signals $y_1[n] \ldots y_N[n]$ $(=[y_t[n]]^T)$ into N direct signal components denoted by $d_t[n]=[d_1[n] \ldots d_N[n]]^T$ and/or N ambient signal components denoted by $a_t[n]=[a_1[n] \ldots a_N[n]]^T$. The processing can be applied for all input channels, or the input signal channels are divided into subsets of channels which are processed separately.

According to embodiments, one or more of the direct signal components $d_1[n], \ldots, d_N[n]$ and/or one or more of the ambient signal components $a_1[n], \ldots, a_N[n]$ shall be estimated from the two or more input channel signals $y_1[n], \ldots, y_N[n]$ to obtain one or more estimations $(\hat{d}_1[n], \ldots, \hat{d}_N[n], \hat{a}_1, \ldots, \hat{a}_N[n])$ of the direct signal components $d_1[n], \ldots, d_N[n]$ and/or of the ambient signal components $a_1[n], \ldots, a_N[n]$ as the one or more output channel signals.

Figure 2:
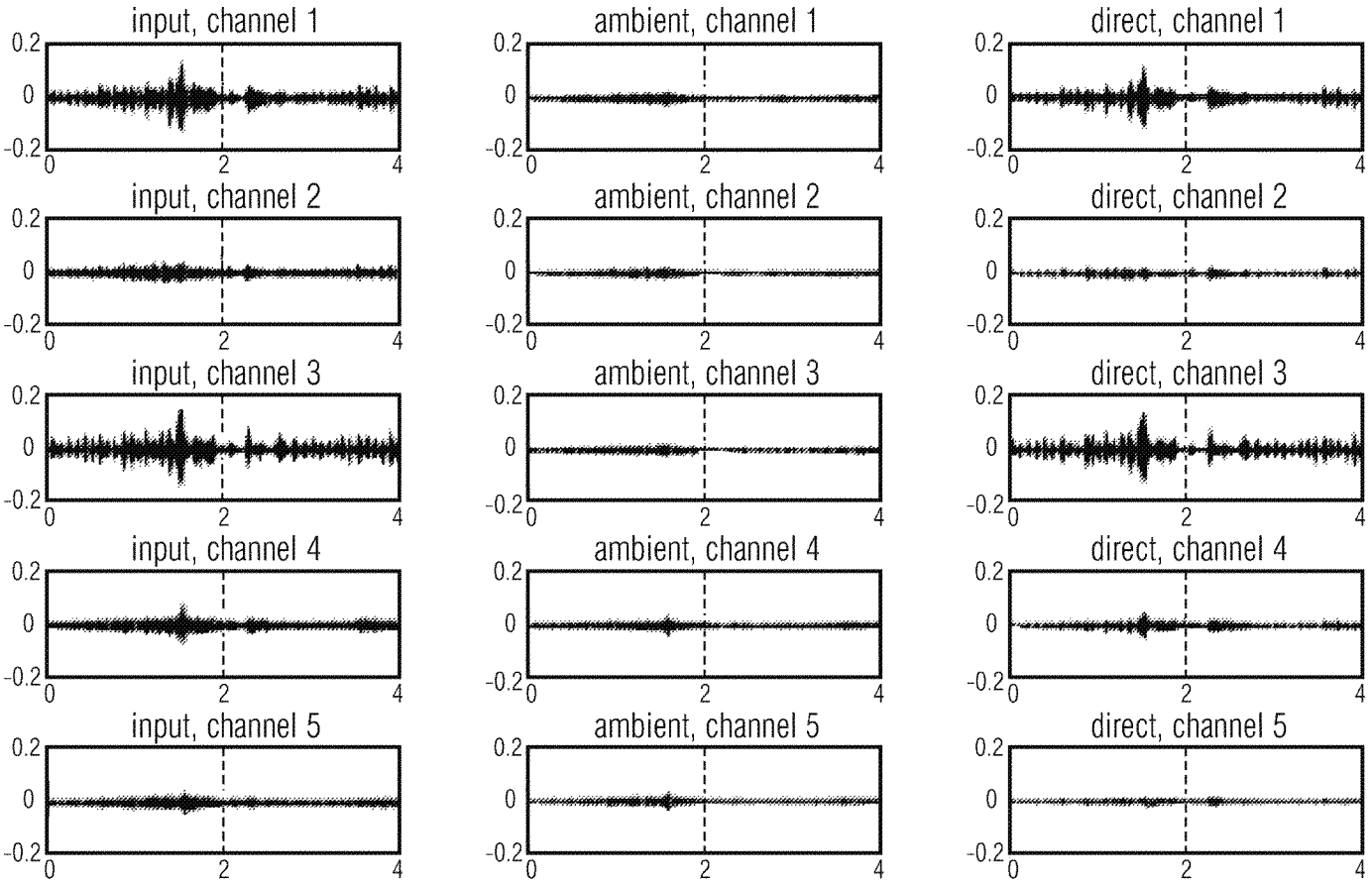
FIG. 2 illustrates input and output signals of the decomposition of a 5-channel recording of classical music, with input signals (left column), ambient output signals (middle column), and direct output signals (right column) according to an embodiment.
Figure 3:
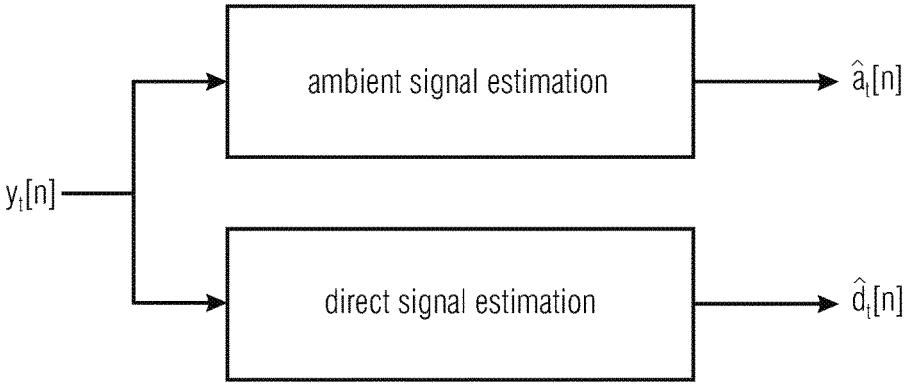
FIG. 3 depicts a basic overview of the decomposition using ambient signal estimation and direct signal estimation according to an embodiment.
Figure 4:
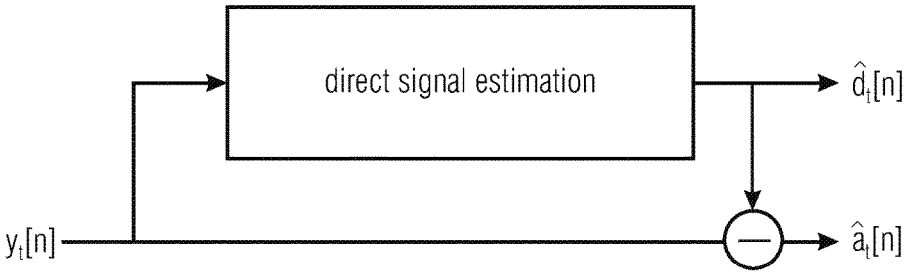
FIG. 4 shows a basic overview of the decomposition using direct signal estimation according to an embodiment.

An example for the provided outputs of some embodiments is depicted in FIG. 2, for N=5. The one or more audio output channel signals $\hat{d}_1[n], \ldots, \hat{d}_N[n]$ $(=[\hat{d}_t[n]]^T)$, $\hat{a}_t[n], \ldots, \hat{a}_N[n]$ $(=[\hat{a}_t[n]]^T)$ are obtained by estimating the direct signal components and the ambient signal components independently, as depicted in FIG. 3. Alternatively, an estimate $(\hat{d}_t[n]$ or $\hat{a}_t[n])$ for one of the two signals (either $d_t[n]$ or $a_t[n]$) is computed and the other signal is obtained by subtracting the first result from the input signal. FIG. 4 illustrates the processing for estimating the direct signal components $d_t[n]$ first and deriving the ambient signal components $a_t[n]$ by subtracting the estimate of direct signals from the input signal. With a similar rationale, the estimation of the ambient signal components can be derived first as illustrated in the block diagram in FIG. 5.

According to embodiments, the processing may, for example, be performed in the time-frequency domain. A time-frequency domain representation of the input audio signal may, for example, be obtained by means of a filterbank (the analysis filterbank), e.g. the Short-time Fourier transform (STFT).

Figure 6A:
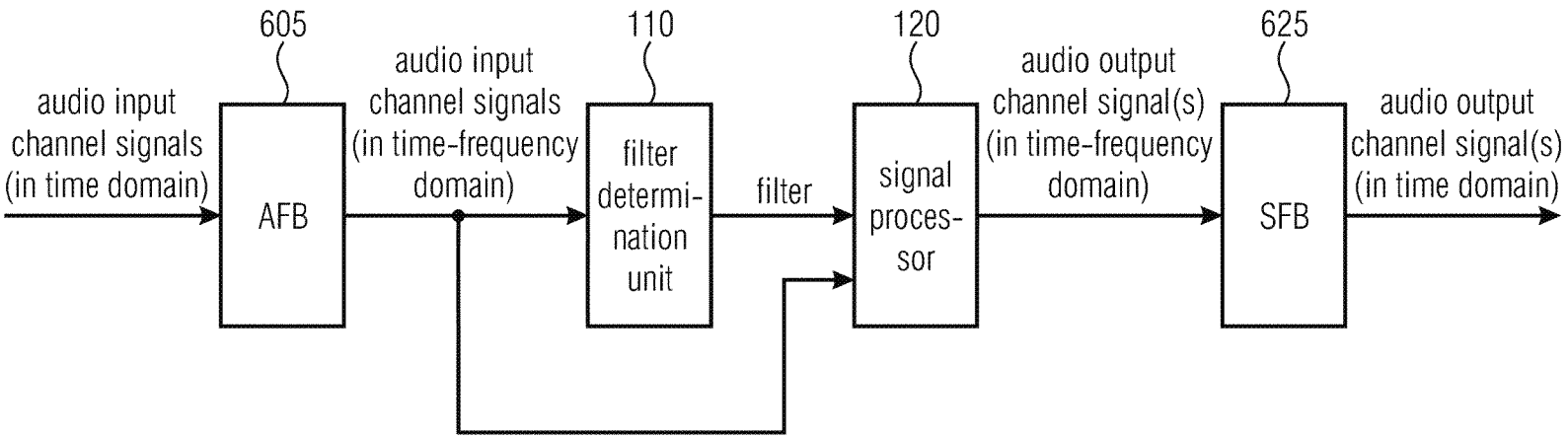
FIG. 6*a* illustrates an apparatus according to another embodiment, wherein the apparatus further comprises an analysis filterbank and a synthesis filterbank.

According to an embodiment illustrated by FIG. 6*a*, an analysis filterbank 605 transforms the audio input channel signals $y_t[n]$ from the time domain to the time-frequency domain. Moreover, in FIG. 6*a*, a synthesis filterbank 625 transforms the estimation of the direct signal components $\hat{d}[m,1], \ldots, \hat{d}[m,k]$ from the time-frequency domain to the time domain, to obtain the audio output channel signals $\hat{d}_1[n], \ldots, \hat{d}_N[n]$ $(=[\hat{d}_i[n]]^T)$.

In the embodiment of FIG. 6*a*, the analysis filterbank 605 is configured to transform the two or more audio input channel signals from a time domain to a time-frequency domain. The filter determination unit 110 is configured to determine the filter by estimating the first power spectral density information and the second power spectral density information depending on the audio input channel signals, being represented in the time-frequency domain. The signal processor 120 is configured to generate the one or more audio output channel signals, being represented in a time-frequency domain, by applying the filter on the two or more audio input channel signals, being represented in the time-frequency domain. The synthesis filterbank 625 is configured to transform the one or more audio output channel signals, being represented in a time-frequency domain, from the time-frequency domain to the time domain.

A time-frequency domain representation comprises a certain number of subband signals which evolve over time. Adjacent subbands can optionally be linearly combined into broader subband signals in order to reduce computational complexity. Each subband of the input signals is separately processed, as described in detail in the following. Time domain output signals are obtained by applying the inverse processing of the filterbank, i.e. the synthesis filterbank, respectively. All signals are assumed to have zero mean, the time-frequency domain signals can be modeled as complex random variables.

In the following, definitions and assumptions are provided.

The following definitions are used throughout the description of the devised method: The time-frequency domain representation of a multichannel input signal with N channels is given by $$y(m,k)=[Y_1(m,k)Y_2(m,k) \ldots Y_N(m,k)]^T, \tag{6}$$

with time index m and subband index k, k=1 . . . K and is assumed to be an additive mixture of the direct signal component d(m, k) and the ambient signal component a(m, k), i.e.

$$y(m,k)=d(m,k)+a(m,k), \tag{7}$$

with $$d(m,k)=[D_1(m,k)D_2(m,k) \ldots D_N(m,k)]^T \tag{8}$$

$$a(m,k)=[A_1(m,k)A_2(m,k) \ldots A_N(m,k)]^T, \tag{9}$$

where $D_i(m,k)$ denotes the direct component and $A_i(m,k)$ the ambient component in the i-th channel.

The objective of the direct-ambient decomposition is to estimate d(m,k) and a(m,k). The output signals are computed using the filter matrices $H_D(m,k)$ or $H_A(m,k)$ or both. The filter matrices are of size N×N and are complex-valued, or may, in some embodiments, e.g., be real-valued. An estimate of the N-channel signals of direct signal components and ambient signal components is obtained from $$\hat{d}(m,k)=H_D^H(m,k)y(m,k) \tag{10}$$

$$\hat{a}(m,k)=H_A^H(m,k)y(m,k), \tag{11}$$

Figure 5:
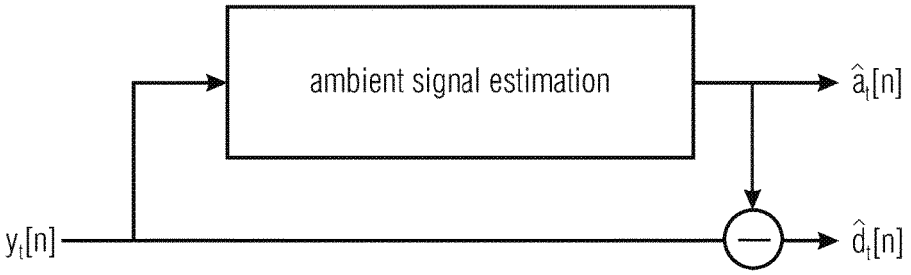
FIG. 5 illustrates a basic overview of the decomposition using ambient signal estimation according to an embodiment.

Alternatively, only one filter matrix can be used, and the subtraction illustrated in FIG. 4 can be expressed as $$\hat{d}(m,k)=H_D^H(m,k)y(m,k) \tag{12}$$

$$\hat{a}(m,k)=[I-H_D(m,k)]^H y(m,k), \tag{13}$$

where I is the identity matrix of size N×N, or, as shown in FIG. 5, as $$\hat{a}(m,k)=H_A^H(m,k)y(m,k) \tag{14}$$

$$\hat{d}(m,k)=[I-H_A(m,k)]^H y(m,k), \tag{15}$$

respectively. Here, superscript $^H$ denotes the conjugate transpose of a matrix or a vector. The filter matrix $H_D(m,k)$ is used for computing estimates for the direct signals $\hat{d}(m,k)$. The filter matrix $H_A(m,k)$ is used for computing estimates for the ambient signals $\hat{a}(m,k)$.

In the above, Formulae (10)-(15), y(m,k) indicates the two or more audio input channel signals. $\hat{a}(m,k)$ indicates an estimation of the ambient signal portions and $\hat{d}(m,k)$ indicates an estimation of the direct signal portions of the audio input channel signals, respectively. $\hat{a}(m,k)$ and/or $\hat{d}(m,k)$ or one or more vector components of $\hat{a}(m,k)$ and/or $\hat{d}(m,k)$ may be the one or more audio output channel signals.

One, some or all of the Formulae (10), (11), (12), (13), (14) and (15) may be employed by the signal processor 120 of FIG. 1 and FIG. 6*a* for applying the filter of FIG. 1 and FIG. 6*a* on the audio input channel signals. The filter of FIG. 1 and FIG. 6*a* may, for example, be $H_D(m,k)$, $H_A(m,k)$, $H_D^H(m,k)$, $H^H_A(m,k)$, $[I-H_D(m,k)]$ or $[I-H_A(m,k)]$. In other embodiments, however, the filter, determined by the filter determination unit 110 and employed by signal processor 120, may not be a matrix but may be another kind of filter. For example, in other embodiments, the filter may comprise one or more vectors which define the filter. In further embodiments, the filter may comprise a plurality of coefficients which define the filter.

The filtering matrices are computed from estimates of the signal statistics as described below. In particular, the filter determination unit 110 is configured to determine the filter by estimating first power spectral density (PSD) information and second PSD information.

Define:

$$\phi x_i x_j(m,k)=E\{X_i(m,k)X_j^*(m,k)\}, \tag{16}$$

where E{•} is the expectation operator and X* denotes complex conjugate of X. For i=j the PSD and for i≠j the cross-PSDs are obtained.

The covariance matrices for y(m, k), d(m,k) and a(m,k) are $$\Phi_y(m,k)=E\{y(m,k)y^H(m,k)\} \tag{17}$$

$$\Phi_d(m,k)=E\{d(m,k)d^H(m,k)\} \tag{18}$$

$$\Phi_a(m,k)=E\{a(m,k)a^H(m,k)\}. \tag{19}$$

The covariance matrices $\Phi_y(m,k)$, $\Phi_d(m,k)$ and $\Phi_a(m,k)$ comprise estimates of the PSD for all channels on the main diagonal, while the off-diagonal elements are estimates of the cross-PSD of the respective channel signals. Thus, each of the matrices $\Phi_y(m,k)$, $\Phi_d(m,k)$ and $\Phi_a(m,k)$ represent an estimation of power spectral density information.

In Formulae (17)-(19), $\Phi_y(m,k)$ indicates an power spectral density information on the two or more audio input channel signals. $\Phi_d(m,k)$ indicates a power spectral density information on the direct signal components of the two or more audio input channel signals. $\Phi_a(m,k)$ indicates a power spectral density information on the ambient signal components of the two or more audio input channel signals.

Each of the matrices $\Phi_y(m,k)$, $\Phi_d(m,k)$ and $\Phi_a(m,k)$ of Formulae (17), (18) and (19) can be considered as power spectral density information. However, it should be noted that in other embodiments, the first and the second power spectral density information is not a matrix, but may be represented in any other kind of suitable format. For example, according to embodiments, the first and/or the second power spectral density information may be represented as one or more vectors. In further embodiments, the first and/or the second power spectral density information may be represented as a plurality of coefficients.

It is assumed that $D_i(m,k)$ and $A_i(m,k)$ are mutually uncorrelated:

$$E\{D_i(m,k)A_j^*(m,k)\}=0\forall i,j,$$

$A_i(m,k)$ and $A_j(m,k)$ are mutually uncorrelated:

$$E\{A_i(m,k)A_j^*(m,k)\}=0\forall i\neq j.$$

The ambience power is equal in all channels:

$$E\{A_i(m,k)A_j^*(m,k)\}=\phi_A(m,k)\forall i=j.$$

As a consequence it holds that $$\Phi_y(m,k)=\Phi_d(m,k)+\Phi_a(m,k), \tag{20}$$

$$\Phi_a(m,k)=\phi_A(m,k)I_{N\times N}, \tag{21}$$

As a consequence of Formula (20) it follows that when two matrices of the matrices $\Phi_y(m,k)$, $\Phi_d(m,k)$ and $\Phi_a(m,k)$ are determined, then the third one of the matrices is immediately available. As a further consequence, it follows that it is enough to determine only:

- power spectral density information on the two or more audio input channel signals, and power spectral density information on the ambient signal portions of the two or more audio input channel signals, or
- power spectral density information on the two or more audio input channel signals, and power spectral density information on the direct signal portions of the two or more audio input channel signals, or
- power spectral density information on the direct signal portions of the two or more audio input channel signals, and power spectral density information on the ambient signal portions of the two or more audio input channel signals, because the third power spectral density information (that has not been estimated) becomes immediately apparent from the relationship of the three kinds of power spectral density information (e.g., by Formula (20) or by any other reformulation of the relationship of the three kinds of power spectral density information (PSD of complete input signal, PSD of ambience components and PSD of direct components), when said three kinds of PSD information are not represented as matrices, but when they are available in another kind of suitable representation, e.g., as one or more vectors, or e.g., as a plurality of coefficients, etc.

For assessing the performance of the devised method, the following signals are defined:

Direct signal distortion:

$$q_d(m,k)^-=[I-H_D(m,k)]^H d(m,k),$$

Residual ambient signal:

$$r_a(m,k)=H_D^H(m,k)a(m,k),$$

Ambient signal distortion:

$$q_a(m,k)=[I-H_A(m,k)]^H a(m,k),$$

Residual direct signal:

$$r_d(m,k)=H_A^H(m,k)d(m,k),$$

In the following, the derivation of the filler matrices are described below according to FIG. 4 and according to FIG. 5. For better readability, the subband indices and time indices are discarded.

At first, embodiments for the estimation of the direct signal components are described.

The rationale of the devised method is to compute the filters such that the residual ambient signal $r_a$ is minimized while constraining the direct signal distortion $q_d$. This leads to the constrained optimization problem $$H_D(\beta_i) = \arg\min_{H_D} E\{\|r_a\|^2\} \quad \text{subject to } E\{\|q_d\|^2\} \le \sigma_{d,max}^2, \tag{22}$$

where $\sigma_{d,max}^2$ is the maximum allowable direct signal distortion. The solution is given by $$H_D(\beta_i)=[\Phi_d+\beta_i\Phi_a]^{-1}\Phi_d. \tag{23}$$

The filter for computing the direct output signal of the i-th channel equals $$h_{D,i}(\beta_i)=[\Phi_d+\beta_i\Phi_a]^{-1}\Phi_d u_i. \tag{24}$$

where $u_i$ is a null vector of length N with 1 at the i-th position. The parameter $\beta_i$ enables a trade-off between residual ambient signal reduction and ambient signal distortion. For the system depicted in FIG. 4, lower residual ambient levels in the direct output signal leads to higher ambient levels in the ambient output signals. Less direct signal distortion leads to better attenuation of the direct signal components in the ambient output signals. The time and frequency dependent parameter $\beta_i$ can be set separately for each channel and can be controlled by the input signals or signals derived therefore; as described below.

It is noted that a similar solution can be obtained by formulating the constrained optimization problem as $$H_D(\beta_i) = \arg\min_{H_D} E\{\|q_d\|^2\} \quad \text{subject to } E\{\|r_a\|^2\} \le \sigma_{a,max}^2, \tag{25}$$

When $\Phi_d$ is of rank one, the relation between $\sigma_{d,max}^2$ and $\beta_i$ for the i-th channel signal is derived as $$\sigma_{d,max}^2 = \left(\frac{\beta_i}{\beta_i+\lambda}\right)^2 \phi D_i D_i. \tag{26}$$

where $\phi_{D_iD_i}$ is the PSD of the direct signal in the i-th channel, and $\lambda$ is the multichannel direct-to-ambient ratio (DAR)

$$\lambda = tr\{\Phi_a^{-1}\Phi_d\} \tag{27}$$

$$= tr\{\Phi_a^0\Phi_y\} - N, \tag{28}$$

where the trace of a square matrix A equals the sum of the elements on the main diagonal, $$tr\{K\} = \sum_{i=1}^{N} k_{ii}(m,k).$$

It should be noted that the statement, that $\Phi_d$ is of rank one, is only an assumption. No matter whether in reality this assumption is true or not, embodiments of the present invention employ the above Formulae (26), (27) and (28), even in situations, where, in reality, the exact result of $\Phi_d$ is so that $\Phi_d$ is not of rank one. In such situations, embodiments of the present invention also provide good results, even when the assumption, that $\Phi_d$ is of rank one, is, in reality, not true.

In the following, an estimation of the ambient signal components is described.

The rationale of the devised method is to compute the filters such that the residual direct signal $r_d$ is minimized while constraining the ambient signal distortion $q_a$. This leads to the constrained optimization problem $$H_A(\beta_i) = \underset{H_A}{\operatorname{argmin}} E\{\|r_d\|^2\} \quad \text{subject to } E\{\|q_a\|^2\} \le \sigma^2_{a,\max}, \tag{29}$$

where $\sigma_{a,max}^2$ is the maximum allowable ambient signal distortion. The solution is given by $$H_A(\beta_i)=[\beta_i\Phi_d+\Phi_a]^{-1}\Phi_a, \tag{30}$$

The filter for computing the ambient output signal of the i-th channel equals $$h_{A,i}(\beta_i)=[\beta_i\Phi_d+\Phi_a]^{-1}\Phi_a u_i. \tag{31}$$

In the following, embodiments are provided in detail which realize concepts of the present invention.

To determine power spectral density information, for example, the PSD matrix of the audio input channel signals $\Phi_y$ might be estimated directly using short-time moving averaging or recursive averaging. The ambient PSD matrix $\Phi_a$, may, for example, be estimated as described below. The direct PSD matrix $\Phi_d$, may, for example, be then obtained using Formula (20).

In the following, it is again assumed that not more than one direct sound source is active at a time in each subband (single direct source), and that consequently $\Phi_d$ is of rank one.

It should be noted that the statements, that not more than one direct sound source is active, and that $\Phi_d$ is of rank one, are only assumptions. No matter whether in reality these assumptions are true or not, embodiments of the present invention employ the formulae below, in particular, Formulae (32) and (33), even in situations, where, in reality, more than one direct sound source is active, and even when, in reality, the exact result of $\Phi_d$ is so that $\Phi_d$ is not of rank one. In such situations, embodiments of the present invention also provide good results, even when the assumptions, that not more than one direct sound source is active, and that $\Phi_d$ is of rank one, are, in reality, not true.

Thus, assuming that not more than one direct sound source is active, and that $\Phi_d$ is of rank one, Formula (23) can be written as $$H_D(\beta_i) = \frac{\Phi_a^{-1}\Phi_d}{\beta_i+\lambda} \tag{32}$$

$$= \frac{\Phi_a^{-1}\Phi_y - I_{N\times N}}{\beta_i+\lambda}. \tag{33}$$

Formula (33) provides a solution for the constrained optimization problem of Formula (22).

In the above Formulae (32) and (33), $\Phi_a^{-1}$ is the inverse matrix of $\Phi_a$. It is apparent that $\Phi_a^{-1}$ also indicates power spectral density information on the ambient signal portions of the two or more audio input channel signals.

To determine $H_D(\beta_i)$, $\Phi_a^{-1}$ and $\Phi_d$ have to be determined. When $\Phi_a$ is available, $\Phi_a^{-1}$ can be immediately be determined. $\lambda$ is defined in according to Formulae (27) and (28) and its value is available when $\Phi_a^{-1}$ and $\Phi_d$ are available. Besides determining $\Phi_a^{-1}$, $\Phi_d$ and $\lambda$, a suitable value for $\beta_i$ has to be chosen.

Moreover, Formula (33) can be reformulated (see Formula (20)), so that:

$$H_D(\beta_i) = \frac{(\Phi_y-\Phi_d)^{-1}\Phi_y - I_{N\times N}}{\beta_i+\lambda} \tag{33a}$$

and, thus, so that only the PSD information $\Phi_y$ on the audio input channel signals and the PSD information $\Phi_d$ on the direct signal portions of the audio input channel signals have to be determined.

Moreover, Formula (33) can be reformulated (see Formula (20)), so that:

$$H_D(\beta_i) = \frac{\Phi_a^{-1}(\Phi_d+\Phi_a) - I_{N\times N}}{\beta_i+\lambda} \tag{33b}$$

and, thus, so that only the PSD information $\Phi_a^{-1}$ on the ambient signal portions of the audio input channel signals and the PSD information $\Phi_d$ on the direct signal portions of the audio input channel signals have to be determined.

Furthermore, Formula (33) can be reformulated, so that:

$$H_A(\beta_i) = I_{N\times N} - \frac{\Phi_a^{-1}\Phi_y - I_{N\times N}}{\beta_i+\lambda} \tag{33c}$$

and, thus, so that $H_A(\beta_i)$ is determined.

Formula (33c) provides a solution for the constrained optimization problem of Formula (29).

Similarly, Formulae (33a) and (33b) can be reformulated to:

$$H_A(\beta_i) = I_{N\times N} - \frac{(\Phi_y-\Phi_d)^{-1}\Phi_y - I_{N\times N}}{\beta_i+\lambda} \tag{33d}$$

or to:

$$H_A(\beta_i) = I_{N\times N} - \frac{\Phi_a^{-1}(\Phi_d+\Phi_a) - I_{N\times N}}{\beta_i+\lambda} \tag{33e}$$

It should be noted that by determining $H_D(\beta_i)$, the filter $H_A(\beta_i)$ is immediately available as: $H_A(\beta_i)=I_{N\times N}-H_D(\beta_i)$.

Furthermore, it should be noted that by determining $H_A(\beta_i)$, the filter $H_D(\beta_i)$ is immediately available as: $H_D(\beta_i)=I_{N\times N}-H_A(\beta_i)$.

As stated above, to determine $H_D(\beta_i)$, e.g., according to Formula (33), $\Phi_y$ and $\Phi_a$ may be determined:

The PSD matrix of the audio Signals $\Phi_y(m,k)$ can, for example, be estimated directly, for example, by using recursive averaging $$\Phi_y(m,k)=(1-\alpha)y(m,k)y^H(m,k)+\alpha\Phi_y(m-1,k), \tag{34a}$$

where $\alpha$ is a filter coefficient which determines the integration time, or for example, by using short-time moving weighted averaging $$\Phi_y(m,k)=b_0\cdot y(m,k)y^H(m,k)+b_1\cdot y(m-1,k)y^H(m-1,k)+b_2\cdot y(m-2,k)y^H(m-2,k)+\ldots+b_L\cdot y(m-L,k)y^H(m-L,k) \quad (34b)$$

where L is, e.g., the number of past values used for the computation of the PSD, and $b_0 \ldots b_L$ are the filter coefficients which are, for example, in the range [0 1](e.g., 0≤filter coefficient≤1), or for example, by using short-time moving averaging, according to Equation (34b) but with $$b_i = \frac{1}{L+1}$$

for all i=0 . . . L.

Now, estimating the ambient PSD matrix $\Phi_a$ according to embodiments is described.

The ambient PSD matrix $\Phi_a$ is given by $$\Phi_a=\hat{\phi}_A I_{N\times N}, \quad (35)$$

where $I_{N\times N}$ is the identity matrix of size N×N. $\hat{\phi}_A$ is, e.g., a number.

One solution according to an embodiment is, for example, obtained by using a constant value, by using Formula (21) and setting $\hat{\phi}_A$ to a real-positive constant ε. The advantage of this approach is that the computational complexity is negligible.

In embodiments, the filter determination unit 110 is configured to determine $\hat{\phi}_A$ depending on the two or more audio input channel signals.

An option with very low computational complexity is, according to an embodiment, to use a fraction of the input power and to set $\hat{\phi}_A$ to the mean value or the minimum value of the input PSD or a fraction of it, e.g.

$$\hat{\phi}_A = \frac{g}{N} tr\{\Phi_y\}, \quad (36)$$

where the parameter g controls the amount of ambience power, and 0<g<1.

According to a further embodiment, an estimation is conducted based on the arithmetic mean. Given the assumption that lead to Formula (20) and Formula (21), it can be shown that the PSD $\hat{\phi}_A$ can be computed using $$\hat{\phi}_A = \frac{1}{N} tr\{\Phi_y - \Phi_d\} \quad (37)$$

$$= \frac{1}{N}(tr\{\Phi_y\} - tr\{\Phi_d\}). \quad (38)$$

While $tr\{\Phi_y\}$ can be directly computed using e.g. the recursive integration of Formula (34a), or, e.g., the short-time moving weighted averaging of Formula (34b), $tr\{\Phi_d\}$ is estimated as $$tr\{\Phi_d\} = \frac{1}{N-1}\sum_{i=1}^{N-1}\sum_{j=i+1}^{N}\left[\left(\phi_{Y_iY_i} - \phi_{Y_jY_j}\right)^2 + 4\mathrm{Re}\{\phi_{Y_iY_j}\}^2\right]^{\frac{1}{2}}. \quad (39)$$

-continued $$4\mathrm{Re}\{\phi_{Y_iY_j}\}^2]^{\frac{1}{2}}. \quad (40)$$

Alternatively, the PSD $\hat{\phi}_A(m,k)$ can be computed for N>2 by choosing two input channel signals and estimating $\hat{\phi}_A(m,k)$ only for one pair of signal channels. More accurate results are obtained when applying this procedure to more than one pair of input channel signals and combining the results, e.g. by averaging overall estimates. The subsets can be chosen by taking advantage of a-priori about channels having similar ambient power, e.g. by estimating the ambient power separately in all rear channels and all front channels of a 5.1 recording.

Moreover, it should be noted that from Formulae (20) and (35), it follows that $$\Phi_d=\Phi_y-\hat{\phi}_A I_{N\times N}. \quad (35a)$$

According to some embodiments, $\Phi_d$ is determined by determining $\hat{\phi}_A$ (e.g., according to Formula (35), or Formula (36) or according to Formulae (37)-(40)) and by employing Formula (35a) to obtain the power spectral density information on the ambient signal portions of the audio input channel signals. Then, $H_D(\beta_i)$ may be determined, for example, by employing Formula (33a).

In the following, the choice for the parameter $\beta_i$ is considered.

$\beta_i$ is a trade-off parameter. The trade-off parameter $\beta_i$ is a number.

In some embodiments, only one trade-off parameter $\beta_i$ is determined which is valid for all of the audio input channel signals, and this trade-off parameter is then considered as the trade-off information of the audio input channel signals.

In other embodiments, one trade-off parameter $\beta_i$ is determined for each of the two or more audio input channel signals, and these two or more trade-off parameters of the audio input channel signals then form together the trade-off information.

In further embodiments, the trade-off information may not be represented as a parameter but may be represented in a different kind of suitable format.

As noted above, the parameter $\beta_i$ enables a trade-off between ambient signal reduction and direct signal distortion. It can either be chosen to be constant, or signal-dependent, as shown in FIG. 6*b*.

Figure 6B:
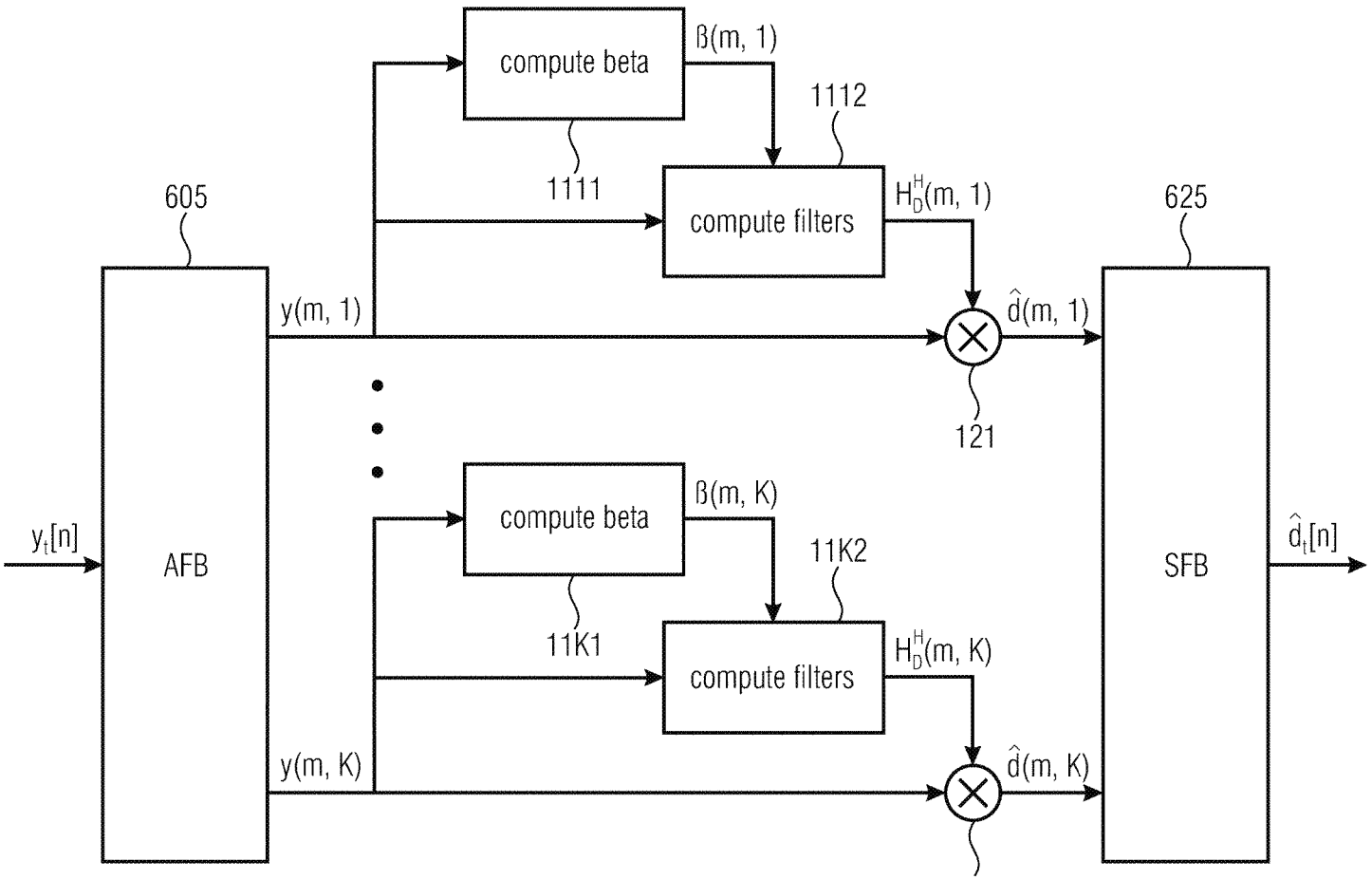
FIG. 6*b* depicts an apparatus according to a further embodiment, illustrating the extraction of the direct signal components, wherein the block AFB is a set of N analysis filterbanks (one for each channel), and wherein SFB is a set of synthesis filterbanks.

FIG. 6*b* illustrates an apparatus according to a further embodiment. The apparatus comprises an analysis filterbank 605 for transforming the audio input channel signals $y_i[n]$ from the time domain to the time-frequency domain. Moreover, the apparatus comprises a synthesis filterbank 625 for transforming the one or more audio output channel signals, (e.g., the estimated direct signal components $\hat{d}_1[n], \ldots, \hat{d}_N[n]$ of the audio input channel signals) from the time-frequency domain to the time domain.

A plurality of K beta determination units 1111, . . . , 11K1 ("compute Beta") determine the parameters $\beta_i$. Moreover, a plurality of K subfilter computation units 1112, . . . , 11K2 determine subfilters $H_D^H(m,1), \ldots, H_D^H(m,K)$. The plurality of the beta determination units 1111, . . . , 11K1 and the plurality of the subfilter computation units 1112, . . . , 11K2 together form the filter determination unit 110 of FIG. 1 and FIG. 6*a* according to a particular embodiment. The plurality of subfilters $H_D^H(m,1), \ldots, H_D^H(m,K)$ together form the filter of FIG. 1 and FIG. 6*a* according to a particular embodiment.

Moreover, FIG. 6*b* illustrates a plurality of signal subprocessors 121, . . . , 12K, wherein each signal subprocessor 121, . . . , 12K is configured to apply one of the subfilters $H_D^H(m,1), \ldots, H_D^H(m,K)$ on one of the audio input channel signals to obtain one of the audio output channel signals. The plurality of signal subprocessors 121, . . . , 12K together form the signal processor of FIG. 1 and FIG. 6*a* according to a particular embodiment.

In the following, different use cases for controlling the parameter $\beta_i$ by means of signal analysis are described.

At first, transient signals are considered.

According to an embodiment, the filter determination unit 110 is configured to determine the trade-off information ($\beta_i$, $\beta_j$) depending on whether a transient is present in at least one of the two or more audio input channel signals.

The estimation of the input PSD matrix works best for stationary signal. On the other hand, the decomposition of transient input signal can result in leakage of the transient signal component into the ambient output signal. Controlling $\beta_i$ by means of a signal analysis with respect to the degree of non-stationarity or transient presence probability such that $\beta_i$ is smaller when the signal comprises transients and larger in sustained portions leads to more consistent output signals when applying filters $H_D(\beta_i)$. Controlling $\beta_i$ by means of a signal analysis with respect to the degree of non-stationarity or transient presence probability such that $\beta_i$ is larger when the signal comprises transients and smaller in sustained portions leads to more consistent output signals when applying filters $H_A(\beta_i)$.

Now, undesired ambient signals are considered.

In an embodiment, the filter determination unit 110 is configured to determine the trade-off information ($\beta_i$, $\beta_j$) depending on a presence of additive noise in at least one signal channel through which one of the two or more audio input channel signals is transmitted.

The proposed method decomposes the input signals regardless of the nature of the ambient signal components. When the input signals have been transmitted over noisy signal channels, it is advantageous to estimate the probability of undesired additive noise presence and to control $\beta_i$ such that the output DAR (direct-to-ambient ratio) is increased.

Now, controlling the levels of the output signals is described.

In order to control the levels of output signals, $\beta_i$ can be set separately for the i-th channel. The filters for computing the ambient output signal of the i-th channel are given by Formula (31).

For any two channels, $\beta_i$ can be computed given $\beta_i$ such that the PSDs of the residual ambient signals $r_{a,i}$ and $r_{a,j}$ at the i-th and j-th output channel are equal, i.e., $$h_{A,i}^H(\beta_i)\Phi_a h_{A,i}(\beta_i)=h_{A,j}^H(\beta_j)\Phi_a h_{A,j}(\beta j). \tag{41}$$

or $$(u_i-h_{D,i}(\beta_i))^H\Phi_a(u_i-h_{D,i}(\beta_i))=(u_j-h_{D,j}(\beta_j))^H\Phi_a(u_j-h_{D,j}(\beta_j)). \tag{42}$$

Alternatively, $\beta_i$ can be computed such that the PSDs of the output ambient signals $\hat{a}_i$ and $\hat{a}_j$ are equal for all pairs i and j.

Now, using panning information is considered.

For the case of two input channels, panning information quantifies level differences between both channels per subband. The panning information can be applied for controlling $\beta_i$ in order to control the perceived width of the output signals.

In the following, equalizing output ambient channel signals is considered.

The described processing does not ensure that all output ambient channel signals have equal subband powers. To ensure that all output ambient channel signals have equal subband powers, the filters are modified as described in the following for the embodiment using filters $H_D$ as described above. The covariance matrix of the ambient output signal (comprising the auto-PSDs of each channel on the main diagonal) can be obtained as $$\Phi_{\hat{a}}=(I-H_D)^H\Phi_y(I-H_D). \tag{43}$$

In order to ensure that the PSDs of all output ambient channels are equal, the filters $H_D$ are replaced by $\tilde{H}_D$:

$$\tilde{H}_D=I-G(I-H_D)=I-G+GH_D \tag{44}$$

where G is a diagonal matrix whose elements on the main diagonal are $$g_{ii}=\sqrt{\frac{tr\{\Phi_{\hat{a}}\}}{N\phi_{\hat{A}_i,\hat{A}_i}}},\ 1\le i\le N. \tag{45}$$

For the embodiment using filters $H_A$ as described above, the covariance matrix of the ambient output signal (comprising the auto-PSDs of each channel on the main diagonal) can be obtained as $$\Phi_{\hat{a}}\times H_A^H\Phi_y H_A. \tag{46}$$

In order to ensure that the PSDs of all output ambient channels are equal, the filters $H_A$ are replaced by $\tilde{H}_A$:

$$\tilde{H}_A=GH_A \tag{47}$$

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] J. B. Allen, D. A. Berkeley, and J. Blauert, "Multimicrophone signal-processing technique to remove room reverberation from speech signals", J. Acoust. Soc. Am., vol. 62, 1977.

[2] C. Avendano and J.-M. Jot, "A frequency-domain approach to multi-channel upmix", J. Audio Eng. Soc., vol. 52, 2004.

[3] C. Faller, "Multiple-loudspeaker playback of stereo signals", J. Audio Eng. Soc., vol. 54, 2006.

[4] J. Merimaa, M. Goodwin, and J.-M. Jot, "Correlation-based ambience extraction from stereo recordings", in Proc. of the AES 123rd Conv., 2007.

[5] Ville Pulkki, "Directional audio coding in spatial sound reproduction and stereo upmixing", in Proc. of the AES 28th Int. Conf., 2006.

[6] J. Usher and J. Benesty, "Enhancement of spatial sound quality: A new reverberation-extraction audio upmixer", IEEE Tram. on Audio, Speech. and Language Processing, vol. 15, pp. 2141-2150, 2007.

[7] A. Walther and C. Faller, "Direct-ambient decomposition and upmix of surround sound signals", in Proc. of IEEE WASPAA, 2011.

[8] C. Uhle, J. Herre, S. Geyersberger, F. Ridderbusch, A. Walter; and O. Moser, "Apparatus and method for extracting an ambient signal in an: apparatus and method for obtaining weighting coefficients for extracting an ambient signal and computer program", US Patent Application 2009/0080666, 2009.

[9] C. Uhle, J. Herre, A. Walther, O. Hellmuth, and C. Janssen, "Apparatus and method for generating an ambient signal from an audio signal, apparatus and method for deriving a multi-channel audio signal from an audio signal and computer program", US Patent Application 2010/0030563, 2010.

[10] G. Soulodre, "System for extracting and changing the reverberant content of an audio input signal", U.S. Pat. No. 8,036,767, Date of patent: Oct. 11, 2011.

The invention claimed is:

1. An apparatus for generating one or more audio output channel signals depending on two or more audio input channel signals, wherein each of the two or more audio input channel signals comprises direct signal portions and ambient signal portions, wherein the apparatus comprises:

a filter determination unit configured to calculate a filter by estimating first power spectral density information and by estimating second power spectral density information, wherein the filter depends on the first power spectral density information and on the second power spectral density information, wherein the filter determination unit is configured to calculate the filter by estimating the first power spectral density information, by estimating the second power spectral density information, and by determining trade-off information depending on at least one of the two or more audio input channel signals, and a signal processor configured to determine the one or more audio output channel signals by applying the filter on the two or more audio input channel signals, wherein the one or more audio output channel signals depend on the filter, wherein the first power spectral density information indicates power spectral density information on the two or more audio input channel signals, and the second power spectral density information indicates power spectral density information on the ambient signal portions of the two or more audio input channel signals, or wherein the first power spectral density information indicates the power spectral density information on the two or more audio input channel signals, and the second power spectral density information indicates power spectral density information on the direct signal portions of the two or more audio input channel signals, or wherein the first power spectral density information indicates the power spectral density information on the direct signal portions of the two or more audio input channel signals, and the second power spectral density information indicates the power spectral density information on the ambient signal portions of the two or more audio input channel signals.

2. An apparatus according to claim 1, wherein the apparatus furthermore comprises an analysis filterbank configured to transform the two or more audio input channel signals from a time domain to a time-frequency domain, wherein the filter determination unit is configured to calculate the filter by estimating the first power spectral density information and the second power spectral density information depending on the audio input channel signals, being represented in the time-frequency domain, wherein the signal processor is configured to generate the one or more audio output channel signals, being represented in a time-frequency domain, by applying the filter on the two or more audio input channel signals, being represented in the time-frequency domain, and wherein the apparatus furthermore comprises a synthesis filterbank for transforming the one or more audio output channel signals, being represented in a time-frequency domain, from the time-frequency domain to the time domain.

3. An apparatus according to claim 1, wherein the filter determination unit is configured to determine the trade-off information depending on whether a transient is present in at least one of the two or more audio input channel signals.

4. An apparatus according to claim 1, wherein the filter determination unit is configured to determine the trade-off information depending on a presence of additive noise in at least one signal channel through which one of the two or more audio input channel signals is transmitted.

5. An apparatus according to claim 1, wherein the filter determination unit is configured to determine a trade-off parameter for each of two or more audio input channel signals as the trade-off information, wherein the trade-off parameter of each of the audio input channel signals depends on said audio input channel signal.

6. An apparatus according to claim 1, wherein the filter determination unit is configured to determine the power spectral density information on the two or more audio input channel signals depending on a first matrix, the first matrix comprising an estimation of the power spectral density for each channel signal of the two or more audio input channel signals on the main diagonal of the first matrix, and is configured to determine the power spectral density information on the ambient signal portions of the two or more audio input channel signals depending on a second matrix or depending on an inverse matrix of the second matrix, the second matrix comprising an estimation of the power spectral density for the ambient signal portions of each channel signal of the two or more audio input channel signals on the main diagonal of the second matrix, or wherein the filter determination unit is configured to determine the power spectral density information on the two or more audio input channel signals depending on the first matrix, and is configured to determine the power spectral density information on the direct signal portions of the two or more audio input channel signals depending on a third matrix or depending on an inverse matrix of the third matrix, the third matrix comprising an estimation of the power spectral density for the direct signal portions of each channel signal of the two or more audio input channel signals on the main diagonal of the third matrix, or wherein the filter determination unit is configured to determine the power spectral density information on the ambient signal portions of the two or more audio input channel signals depending on the second matrix or depending on an inverse matrix of the second matrix, and is configured to determine the power spectral density information on the direct signal portions of the two or more audio input channel signals depending on the third matrix or depending on an inverse matrix of the third matrix.

7. An apparatus according to claim 6, wherein the filter determination unit is configured to determine the first matrix to determine the power spectral density information on the two or more audio input channel signals, and is configured to determine the second matrix or an inverse matrix of the second matrix to determine the power spectral density information on the ambient signal portions of the two or more audio input channel signals, or wherein the filter determination unit is configured to determine the first matrix to determine the power spectral density information on the two or more audio input channel signals, and is configured to determine the third matrix or an inverse matrix of the third matrix to determine the power spectral density information on the direct signal portions of the two or more audio input channel signals, or wherein the filter determination unit is configured to determine the second matrix or an inverse matrix of the second matrix to determine the power spectral density information on the ambient signal portions of the two or more audio input channel signals, and is configured to determine the third matrix or an inverse matrix of the third matrix to determine the power spectral density information on the ambient signal portions of the two or more audio input channel signals.

8. An apparatus according to claim 6, wherein the filter determination unit is configured to calculate the filter $H_D(\beta_i)$ depending on the formula $$H_D(\beta_i) = \frac{\Phi_a^{-1}\Phi_y - I_{N\times N}}{\beta_i + \lambda}$$

or depending on the formula $$H_D(\beta_i) = \frac{(\Phi_y - \Phi_d)^{-1}\Phi_y - I_{N\times N}}{\beta_i + \lambda}$$

or depending on the formula $$H_D(\beta_i) = \frac{\Phi_a^{-1}(\Phi_d + \Phi_a) - I_{N\times N}}{\beta_i + \lambda},$$

or wherein the filter determination unit is configured to calculate the filter $H_A(\beta_i)$ depending on the formula $$H_A(\beta_i) = I_{N\times N} - \frac{\Phi_a^{-1}\Phi_y - I_{N\times N}}{\beta_i + \lambda}$$

or depending on the formula $$H_A(\beta_i) = I_{N\times N} - \frac{(\Phi_y - \Phi_d)^{-1}\Phi_y - I_{N\times N}}{\beta_i + \lambda}$$

or depending on the formula $$H_A(\beta_i) = I_{N\times N} - \frac{\Phi_a^{-1}(\Phi_d + \Phi_a) - I_{N\times N}}{\beta_i + \lambda},$$

wherein $\Phi_y$ is the first matrix,
wherein $\Phi_a$ is the second matrix,
wherein $\Phi_a^{-1}$ is the inverse matrix of the second matrix,
wherein $\Phi_d$ is the third matrix,
wherein $I_{N\times N}$ is a unit matrix of size N×N,
wherein N indicates the number of the audio input channel signals,
wherein $\beta_i$ is the trade-off information being a number, and
wherein $\lambda = \mathrm{tr}\{\Phi_a^{-1}\Phi_d\}$,
wherein tr is the trace operator.

9. An apparatus according to claim 8,
wherein the filter determination unit is configured to determine a trade-off parameter for each of two or more audio input channel signals as the trade-off information, so that for each pair of a first audio input channel signal of the audio input channel signals and another second audio input channel signal of the audio input channel signals $$h_{A,i}^H(\beta_i)\Phi_a h_{A,i}(\beta_i) = h_{A,j}^H(\beta_j)\Phi_a h_{A,j}(\beta_j)$$

is true,
wherein $\beta_i$ is the trade-off parameter of said first audio input channel signal,
wherein $\beta_i$ is the trade-off parameter of said second audio input channel signal,
wherein $$h_{A,i}(\beta_i) = [\beta_i\Phi_d + \Phi_a]^{-1}\Phi_a u_i,$$

wherein $H_{A,i}^H(\beta_i)$ is the conjugate transpose matrix of $h_{A,i}(\beta_i)$, and
wherein $u_i$ is a null vector of length N with 1 at the i-th position.

10. An apparatus according to claim 8,
wherein the filter determination unit is configured to determine the second matrix $\Phi_a$ according to the formula $$\Phi_a = \hat{\phi}_A I_{N\times N}, \text{ or}$$

wherein the filter determination unit is configured to determine the third matrix $\Phi_d$ according to the formula $$\Phi_d = \Phi_y - \hat{\phi}_A I_{N\times N},$$

wherein $\hat{\phi}_A$ is a number.

11. An apparatus according to claim 10, wherein the filter determination unit is configured to determine $\hat{\phi}_A$ depending on the two or more audio input channel signals.

12. An apparatus according to claim 1,
wherein the filter determination unit is configured to determine an intermediate filter matrix $H_D$ by estimating first power spectral density information and by estimating second power spectral density information, and
wherein the filter determination unit is configured to determine the filter $\tilde{H}_D$ depending on the intermediate filter matrix $H_D$ according to the formula $$\tilde{H}_D = I - G + GH_D,$$

wherein I is a unit matrix, and
wherein G is a diagonal matrix,
wherein the signal processor is configured to generate the one or more audio output channel signals by applying the filter $\tilde{H}_D$ on the two or more audio input channel signals.

13. A method for generating one or more audio output channel signals depending on two or more audio input channel signals, wherein each of the two or more audio input channel signals comprises direct signal portions and ambient signal portions, wherein the method comprises:
calculating a filter by estimating first power spectral density information and by estimating second power spectral density information, wherein the filter depends on the first power spectral density information and on the second power spectral density information, wherein calculating the filter is conducted by estimating the first power spectral density information, by estimating the second power spectral density information, and by determining trade-off information depending on at least one of the two or more audio input channel signals, and
generating the one or more audio output channel signals by applying the filter on the two or more audio input channel signals, wherein the one or more audio output channel signals depend on the filter,
wherein the first power spectral density information indicates power spectral density information on the two or more audio input channel signals, and the second power spectral density information indicates power spectral density information on the ambient signal portions of the two or more audio input channel signals, or
wherein the first power spectral density information indicates the power spectral density information on the two or more audio input channel signals, and the second power spectral density information indicates power spectral density information on the direct signal portions of the two or more audio input channel signals, or
wherein the first power spectral density information indicates the power spectral density information on the direct signal portions of the two or more audio input channel signals, and the second power spectral density information indicates the power spectral density information on the ambient signal portions of the two or more audio input channel signals.

14. A non-transitory computer-readable medium comprising a computer program for implementing the method of claim 13 when being executed on a computer or processor.

* * * * *